United States Patent [19]

Papadopoulos et al.

[11] Patent Number: 4,548,706

[45] Date of Patent: Oct. 22, 1985

[54] THERMAL CRACKING OF HYDROCARBONS

[75] Inventors: Christos G. Papadopoulos, Lisle; Narasimhan Calamur, Willowbrook, both of Ill.

[73] Assignee: Standard Oil Company (Indiana), Chicago, Ill.

[21] Appl. No.: 461,210

[22] Filed: Jan. 26, 1983

[51] Int. Cl.[4] ..... C10C 9/14

[52] U.S. Cl. ..... 208/130; 585/648; 585/650; 208/132

[58] Field of Search ..... 208/130, 132; 585/648, 585/650

[56] References Cited

U.S. PATENT DOCUMENTS

| | | | |
|---|---|---|---|
| 2,618,668 | 11/1952 | O'Connor et al. | 585/650 |
| 2,816,150 | 12/1957 | Hepp | 585/648 |
| 3,475,510 | 10/1969 | Newman et al. | 208/130 |
| 3,711,568 | 1/1973 | Cooper | 585/648 |
| 3,761,538 | 9/1973 | Espinc et al. | 208/130 |
| 4,324,935 | 4/1982 | Wernicke et al. | 585/650 |

*Primary Examiner*—William R. Dixon, Jr.
*Assistant Examiner*—Cynthia A. Prezlock
*Attorney, Agent, or Firm*—James R. Henes; William T. McClain; Ralph C. Medhurst

[57] ABSTRACT

A method for thermally cracking hydrocarbons under elevated pressure is disclosed.

11 Claims, 2 Drawing Figures

THERMAL CRACKING OF HYDROCARBONS

BACKGROUND OF THE INVENTION

1. Field of the Invention

This invention relates generally to the thermal cracking of hydrocarbons and more particularly concerns the thermal cracking of hydrocarbons under elevated pressure.

2. Description of the Prior Art

The thermal cracking or pyrolysis of paraffinic and naphthenic hydrocarbons is often effected in a thermal reactor, typically comprising tubular reactor coils installed in externally fired heaters. The properties of the feedstock and the conditions at which the reactor is operated determine reactor effluent product distribution. The primary reactions produce olefins essentially via a free radical mechanism. Secondary reactions involving the primary-produced olefins become important when the feedstock reaches high levels of conversion. The feedstock and conditions at which the reactor is operated are generally selected to maximize the yields of light olefins, especially ethylene. High selectivity toward the production of the light olefins and diolefins—that is, ethylene, propylene and butadiene—with minimum methane production and minimum coking in the coils leading to longer heater runs is achieved by operating the reactor heaters at high temperatures (750°-900° C.), short residence times (0.1-0.6 second) and low hydrocarbon partial pressures. Steam is added to the feedstock to reduce the hydrocarbon partial pressure and the amount of carbon being deposited on the reactor walls.

It is desirable to reduce fuel consumption in the thermal cracking of paraffinic and naphthenic hydrocarbons. Furthermore, depending on the feed-stock available and the demands of the marketplace, it is often desirable to shift the reactor effluent product distribution in order to increase the yield of materials that are generally regarded as by-products in the production of the light olefins and diolefins by the thermal cracking of paraffinic and naphthenic hydrocarbons. Generally the formation of by-products in the thermal cracking of paraffins and naphthenes would be favored by increasing the residence time of the feedstock and primarily-produced olefins in the reactor. Decreases in the feed rate and/or in the steam-to-hydrocarbon weight ratio and/or an increase in the reactor length would afford increased residence times. These measures are counterproductive for ethylene yield optimization as practical in state-of-the-art commercial furnaces. For example, a decrease in the feed rate would also produce an undesirable decrease in the reactor throughput. Furthermore, a decrease in the steam-to-hydrocarbon weight ratio can lead to an excessive buildup of coke on the reactor walls. Similarly an increase in reactor length can also lead to an excessive buildup of coke on the reactor walls. Heretofore, no commercially acceptable methods for increasing the yield of higher molecular weight by-products when desired from the thermal cracking of paraffins and naphthenes have been reported.

OBJECTS OF THE INVENTION

It is therefore a general object of the present invention to provide an improved method for the thermal cracking of paraffinic and naphthenic hydrocarbons to solve the aforementioned problems and to meet the aforementioned needs.

More particularly, it is an object of the present invention to provide an improved method for the thermal cracking of paraffinic and naphthenic hydrocarbons under reduced cracking temperatures and hence reduced energy requirements.

Another object of the present invention is to provide an improved method for the thermal cracking of paraffinic and naphthenic hydrocarbons which affords a shift in the reactor effluent product distribution toward increased yields of the higher molecular weight products.

A related object of the present invention is to provide an improved method for the thermal cracking of paraffinic and naphthenic hydrocarbons which affords a synergistic increase in the yield of the higher molecular weight products.

Other objects and advantages of the invention will become apparent upon reading the following detailed description and appended claims and upon reference to the accompanying drawings.

SUMMARY OF THE INVENTION

The present invention is an improvement in a method for thermally cracking a feed comprising at least one hydrocarbon selected from the group consisting of paraffins containing up to 10 carbon atoms, naphthas, gas oils and mixtures thereof, to thereby produce hydrogen, methane, olefins, naphthenes and aromatics. The method comprises passing the feed at a positive pressure into a reactor; cracking the feed in the reactor at a temperature in the range of from about 650° C. to about 930° C. and in the presence of steam, with the steam-to-hydrocarbon ratio being in the range of from about 0.2:1 to about 1.5:1; pressurizing the reactor effluent in a compressor from substantially atmospheric pressure; and fractionating the pressurized reactor effluent; wherein the pressure profile within the reactor is optimized to maximize the yield of ethylene or propylene or both such that the reactor outlet pressure is at a first level. The improvement of the present invention comprises effecting an increase in the reactor pressure profile such that the reactor outlet pressure is maintained at a second level that is at least 30 percent higher than the first level therefor, on an absolute pressure basis.

In a preferred embodiment of the method of this invention, a substantial portion of at one of the olefinic products is combined with fresh hydrocarbons and recycled to the reactor in the feed.

BRIEF DESCRIPTION OF THE DRAWINGS

For a more complete understanding of this invention, reference should now be made to the embodiments illustrated in greater detail in the accompanying drawings and described below by way of examples of the invention. In the drawings.

Figure 1:
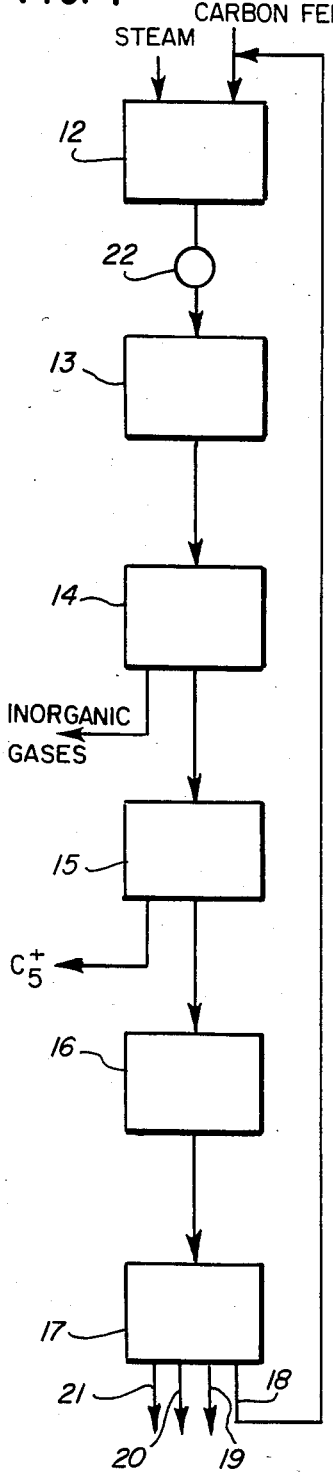
FIG. 1 is a schematic illustration of one embodiment of the method of this invention in which a single feed is introduced into a single reactor and olefinic product is combined with fresh feed and recycled to the reactor.

It should be understod that the drawings are not to scale and that the embodiments are illustrated by graphic symbols, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING PREFERRED EMBODIMENTS

A conventional system for the thermal cracking of paraffins or naphthenes or both comprises a thermal reactor into which the paraffinic and/or naphthenic hydrocarbon feed and steam are introduced at a positive pressure. The effluent from the thermal reactor is a stream comprising a mixture of products typically including hydrogen, methane, and olefins and diolefins such as ethylene, propylene, butenes and butadiene, as well as naphthenes and light aromatics, and of any unreacted feed material. The thermal reactor effluent is then typically passed through a transfer line heat exchanger where the reactor effluent is cooled and the cracking or pyrolysis reaction is quenched. Typically the effluent is cooled in the exchanger by a jacket of water which as a result of the heat exchange process is a source of steam for use in the cracking system. The cooled reactor effluent is then subjected to an oil wash to remove product components containing 5 carbon atoms or more and also to a water wash to remove water-soluble inorganic gases.

Following the wash steps, the cooled reactor effluent is separated into the desired fractions in one or more separators. However, before entering the separator, the reactor effluent is pressurized in a compressor. Compressors employed for this purpose in a thermal cracking system are invariably operated so that the pressure on the reactor effluent entering the compressor is substantially at atmospheric absolute pressure, for example, at 20–25 pounds per square inch absolute.

Conventionally the thermal cracking of hydrocarbons is performed under conditions which are optimized to maximize the yield of ethylene and/or propylene. In particular, although the feed and steam must be introduced into the cracking reactor at a positive pressure which is sufficient to effect movement of the stream through the reactor, heat exchanger, and oil and water washes, the cracking operation is performed at the lowest possible pressure profile within the cracking reactor in order to maximize the ethylene and/or propylene yield. Since the configuration of each cracking reactor may be different from that of any other cracking reactor, the pressure at any given point in a cracking reactor—for example, the pressure at the reactor outlet—may be substantially different than that pressure at the corresponding point in a different cracking reactor. Nevertheless, for any given cracking reactor there is an optimal profile of pressures therein at which the cracking should be performed in order to maximize the yield of ethylene and/or propylene.

By contrast, in the method of the present invention, the thermal cracking operation is performed in a particular cracking reactor at a reactor pressure profile therein which is substantially higher than that pressure profile for the same reactor which is optimized to maximize the yield of ethylene and/or propylene. In particular, in the method of the present invention, the reactor pressure profile is such that the pressure at the reactor outlet is at least 30 percent, preferably at least 100 percent, and more preferably at least 300 percent, higher than the reactor outlet pressure, on an absolute pressure basis, when the reactor pressure profile in the same cracking reactor is optimized to maximize the yield of ethylene and/or propylene. It must be pointed out that the reactor outlet pressure is employed in the present invention merely as a convenient measure by which reactor pressure profiles can be compared quantitatively. Furthermore, even though the cracking system is generally a steady state operation, the pressure at any given point in the cracking reactor—for example, the reactor outlet pressure—may change during the course of the cracking operation as a result of coke formation in the cracking system during the cracking operation. Consequently, it is to be understood that the aforesaid relative increases in the reactor outlet pressure employed in the present invention are based on measurements using a clean, freshly de-coked reactor.

The increased reactor pressure profiles in the present invention can be effected by any convenient method. For example, the reactor pressure profile can be increased by introducing the feed and steam into the reactor at a higher positive pressure than when the pressure profile is set to maximize the yield of ethylene and/or propylene. In the alternative, the pressure downstream of the reactor outlet can be regulated to increase the reactor outlet pressure and hence the reactor pressure profile.

Conventional thermal cracking systems do not employ independent pressure control or maintenance between the outlet of the thermal reactor and the inlet of the compressor, the pressure at any point therebetween is entirely dependent on the pressure at which the feed and steam are introduced to the thermal reactor and the pressure drops across the thermal reactor and across the transfer line heat exchanger, oil and water washes, and any other component of the cracking system therebetween. By contrast, in a preferred embodiment of the method of the present invention, independent regulation of the pressure downstream of the thermal reactor outlet is employed to raise the pressure at the thermal reactor outlet to a level substantially above that of the reactor outlet in the absence of such independent regulation—that is, to a level substantially above that of the reactor outlet in a conventional thermal cracking system.

It will of course be recognized that not only the reactor pressure profile but also the residence time of the reaction and product mixtures in the reactor will be substantially increased over the levels therefor when the pressure profile is set to maximize the yield of ethylene and/or propylene. The increased residence times are a direct result of the increases in the reactor pressure profile.

Surprisingly it has been found that the use of the aforesaid elevated reactor pressure profiles in the method of this invention permits either (1) the attainment of a given product yield and distribution but at reduced cracking temperatures and severities and hence at reduced energy or fuel requirements, or (2) a shift in the product distribution toward increased yields of the higher molecular weight by-products or both (1) and (2).

Referring to FIG. 1, one embodiment of the improved thermal cracking method of this invention is illustrated schematically as comprising introducing a single feed and steam into a single cracking stage 12—for example, comprising one or more externally heated tubular reactor coils—wherein the feed is thermally cracked to form a mixture of products typically including hydrogen, methane, ethylene, propylene, butenes, butadiene, naphthenes and light aromatics as well as some higher molecular weight materials such as fuel oil and polyaromatics whose boiling points are at least 213° C. The fresh feed may be a single material such as ethane or propane or a mixture of materials such as naphtha, gas oil or a mixture of ethane and propane. The effluent from the cracking stage 12 comprises a mixture of products of the cracking operation and of any unreacted feed material and is passed to a heat exchange stage 13 where the reactor effluent is cooled and the cracking reaction is quenched. From there, the cooled reactor effluent is passed to a water wash stage 14 and an oil wash stage 15, where water-soluble inorganic gases and organic compounds containing at least 5 carbon atoms ($C_5+$), respectively, are removed from the reactor effluent. The remaining reactor effluent is then passed to a compression stage 16 where it is pressurized and then to a separation stage 17 wherein the mixture is separated by any convenient and conventional technique or combination of techniques into as many fractions 18, 19, 20 and 21 as desired.

Shown also in FIG. 1 is a pressurization stage 22 comprising some convenient means of pressure regulation, typically a valve, located downstream of the cracking stage 12. The pressurization stage 22 is employed to raise the pressure profile within the cracking stage 12 to a level substantially higher than the level it would otherwise have had in the absence of such pressure regulation and also substantially higher than it would otherwise have had if it had been set to maximize the yield of ethylene or propylene from the cracking reaction. The pressurization stage 22 could be located at any point intermediate the cracking stage 12 and the compression stage 16 but is illustrated in FIG. 1 as being immediately downstream of the cracking stage 12.

Figure 2:
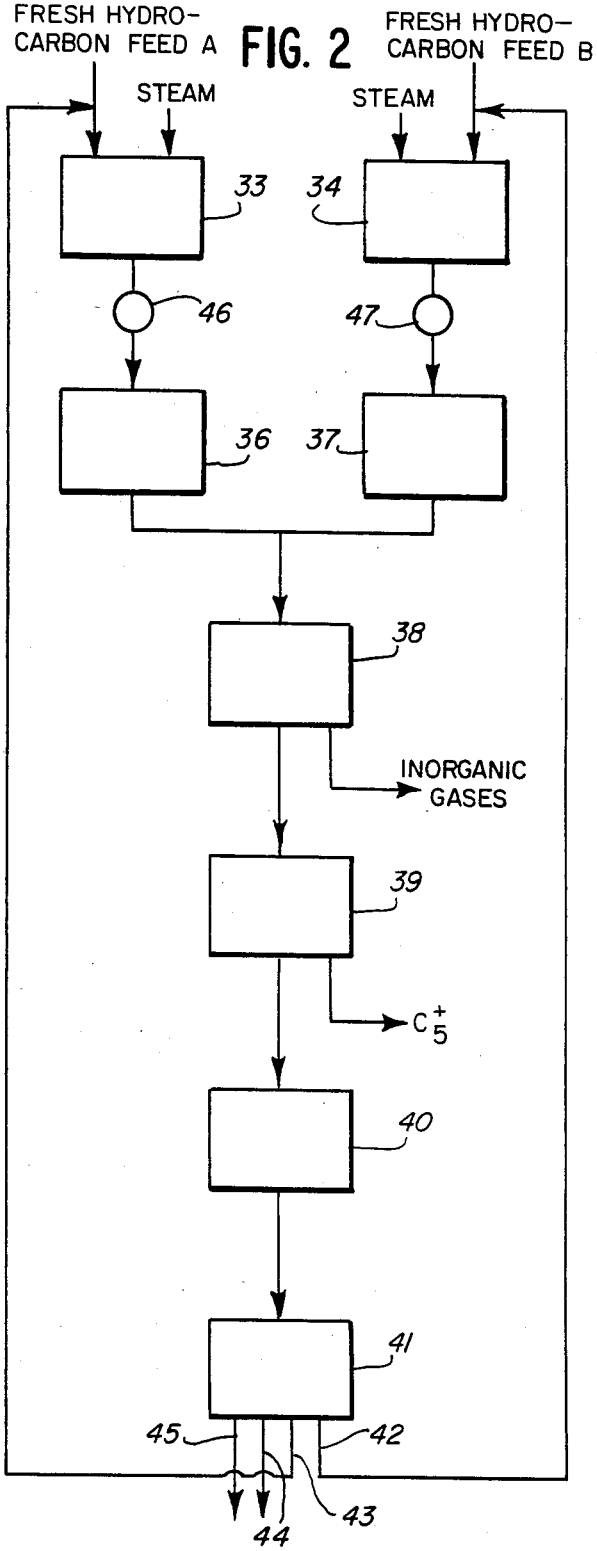
FIG. 2 is a schematic illustration of one embodiment of the method of this invention in which each of two feeds is introduced into a separate reactor and each of two olefinic products is combined with a different one of the fresh feeds and recycled to the reactor.

Turning now to FIG. 2, a second embodiment of the improved thermal cracking method of this invention is illustrated as comprising introducing one feed and steam into a cracking stage 33 and a second feed and steam into a second cracking stage 34—with each cracking stage 33 and 34 comprising one or more externally heated tubular reactor coils—wherein the cracking conditions in each cracking stage are optimized to crack the particular feed to it. for example, in the embodiment illustrated in FIG. 2, fresh Feed A can be ethane or an ethane-rich mixture of ethane and propane, for example, 80 percent by weight of ethane and 20 percent by weight of propane, and fresh Feed B can then be propane or a propane-rich mixture of ethane and propane, such as 20 percent by weight of ethane and 80 percent by weight of propane. In addition, Feed A could be either ethane, propane or a mixture of ethane and propane, and Feed B could then be a naphtha or gas oil. In any event, the cracking conditions employed in cracking stage 33 can be optimized for the cracking therein of Feed A, and the cracking conditions employed in cracking stage 34 can be optimized for the cracking therein of Feed B.

As with the effluent from cracking stage 12 in FIG. 1, the effluent from each of cracking stage 33 and cracking stage 34 in FIG. 2 comprises a mixture of cracking products formed therein and of any unreacted Feed A or B, respectively. As shown in FIG. 2, the effluents from cracking stages 33 and 34 are passed to transfer line heat exchange stages 36 and 37, respectively, wherein the effluents are cooled and the cracking reactions are quenched. From there, the cooled effluents are combined and passed to a single water wash stage 38 and an oil wash stage 39, where water-soluble inorganic gases and organic compounds containing at least 5 carbon atoms ($C_5+$), respectively, are removed from the combined effluent. The remaining effluent is passed to a compression stage 40 where it is pressurized and then to a separation stage 41 where the mixture is separated by any convenient and conventional technique or combination of techniques into as many fractions 42, 43, 44 and 45 as desired.

Shown also in FIG. 2 are pressurization stages 46 and 47—each comprising some convenient means of pressure regulation, typically a valve located downstream of the cracking stages 33 and 34, respectively, and each being used to raise the pressure profiles within the cracking stages 33 and 34, respectively, to levels substantially higher than the levels they would otherwise have had in the absence of such pressure regulation and also substantially higher than they would otherwise have had if they had been set to maximize the yield of ethylene or propylene from the cracking reaction. Alternatively, the pair of pressurization stages 46 and 47 can be replaced by a single pressurization stage located downstream of the point where the effluents from cracking stages 33 and 34 are combined and upstream of the compression stage 40.

Suitable fresh feeds for use in the method of this invention include any and all feeds conventionally employed in the thermal cracking of paraffinic and naphthenic hydrocarbons and, for example, include saturated hydrocarbons having up to 10 carbon atoms, naphthas, gas oils, components thereof and mixtures thereof. Preferably, the fresh hydrocarbon feed is a paraffin of 2 to 4 carbon atoms and mixtures thereof. More preferably the fresh hydrocarbon feed is ethane or propane or a mixture thereof.

In addition, as illustrated in FIGS. 1 and 2, in preferred embodiments of the method of the present invention, the feed to a cracking stage can be a combination of fresh hydrocarbons and a recycled product from the thermal cracking operation. In such case, a substantial portion of at least one of the olefinic products is separated and recycled in line 18 in FIG. 1 and in lines 42 and 43 in FIG. 2 to the fresh feed and returned with the fresh feed to the cracking stage wherein the recycled olefins or their cracking products undergo secondary reactions with the fresh hydrocarbons or other products of the cracking reaction to form higher molecular weight products such as naphthenes and light aromatics.

The use of separate cracking stages as in the embodiment illustrated in FIG. 2 adds a great deal of flexibility to the manner in which a certain fraction of cracking product can be recycled to a cracking stage where it or a cracking product thereof can undergo secondary reactions with fresh hydrocarbons or cracking products thereof to form higher molecular weight products. For example, if Fresh Feed A is ethane or an ethane-rich mixture of ethane and propane and if Fresh Feed B is propane or a propane-rich mixture of ethane and propane, then at least one of ethylene, propylene and butadiene or portions thereof can be recycled and combined with Feed A or Feed B or both. That such variations afford the advantages of either providing higher yields of higher molecular weight products or permitting a given yield of such products to be maintained with a reduced cracking temperature or reduced cracking severity and hence with a reduced consumption of fuel in the furnace will be illustrated in the examples below. Furthermore, it has been surprisingly found that when certain combinations of fresh feed and recycled product are thermally cracked, the yields of higher molecular weight products are especially high, and the requirements for conditions of high cracking temperatures and severities and fuel consumption in the furnace heaters in order to achieve a given yield of such products are especially reduced. The surprisingly superiority of combinations of fresh feed and recycled product will be illustrated in the examples below.

Apart from the reactor pressure profile and the residence time of the reaction and product mixture in the reactor, the conditions conventionally employed for thermally cracking hydrocarbons in a thermal reactor are employed in the method of this invention. The temperature at which the thermal cracking is performed is from about 425° C., preferably from about 480° C., to about 930° C., preferably to about 870° C. Sufficient steam is introduced into the hydrocarbon feed entering or in each thermal reactor such that the steam-to-hydrocarbon weight ratio in each reactor is in the range of from about 0.2:1 to about 1.5:1, preferably to about 1.2:1.

EXAMPLES 1-15

The effect of employing increased reactor pressure profiles in the thermal cracking of hydrocarbons and of recycling a substantial portion of at least one of the olefinic or diolefinic products from the thermal cracking of hydrocarbons, on the energy requirements of the thermal cracking of hydrocarbons and on the yield distribution of products from the thermal cracking of hydrocarbons, was determined using a computer simulation model to estimate the yields for the pyrolysis taking place in the cracking reactor for a range of feed compositions, feed rates, steam-to-hydrocarbon weight ratios, reactor residence times, reactor outlet temperatures and reactor outlet pressures. The particular model employed was SPYRO (for Simulation Pyrolysis) which has been described in the following publications: Dente, M., Ranzi, E., Goossens, A. G., "Detailed Prediction of Olefin Yields from Hydrocarbon Pyrolysis Through a Fundamental Simulation Model (SPYRO)," in Computers and Chemical Engineering, Vol. 3 (1979), pages 61-75; Goossens, A. G., Dente, M., Ranzi, E., Oil and Gas Journal, page 89, Sept. 4, 1978; Goossens, A. G., Dente, M. Ranzi, E., Hydrocabon Processing, page 227, September, 1978; Dente, M., Ranzi, E., Antolini, G., Losco, F., "Symposium on the Use of Computers in the Studies Preceeding the Design of Chemical Plants," Florence, Apr. 27-30, 1970; Ranzi, E., Dente, M., Losco, F., Industria Chimica e Petrolifera, Anno III, Number 12, December, 1975. For the runs of Examples 1-15, the SPYRO model was validated and the yields were measured using the measuring techniques of Calamur et al., U.S. Pat. No. 4,296,637.

The composition, hydrocarbon feed rate, and steam-to-hydrocarbon weight ratio employed in Examples 1-15 are indicated in Table 1, and the reactor outlet temperatures (ROT) in degrees Centrigrade and reactor outlet pressures (ROP) in centimeters of mercury, on an absolute pressure basis, employed and the concentrations in weight percent of various components of the reactor effluent after removal therefrom of the water-soluble inorganic gases are indicated in Table 2. Examples 1 and 6-8 were performed using a reactor in which the average residence time of the feed is in the range of 0.6 to 1.7 seconds and the reactor inlet temperature was 649° C. Examples 2-5 and 9-15 were performed using a reactor in which the average residence time of the feed is in the range of 0.4 to 1.1 seconds and the reactor inlet temperature was 483° C.

It must be recognized that each feed comprising at least one paraffin and at least one olefin or diolefin or at least two paraffins and listed in Table 1 could have been obtained in a variety of recycle operations. For example, the feed in Example No. 1 in Table 2 could have been produced by combining 60 parts by weight of recycled ethylene with 40 parts by weight of a fresh feed mixture of 20 parts by weight of ethane and 20 parts by weight of propane. In the alternative, the feed in Example No. 1 could have been produced by combining 60 parts by weight of recycled ethylene, 10 parts by weight of recycled ethane, 10 parts by weight of fresh ethane and 20 parts by weight of fresh propane.

The runs in Examples Nos. 1, 2 and 4-7 represent thermal cracking in which at least two paraffins are thermally cracked concurrently in the same reactor and under the same cracking conditions. The runs in Examples Nos. 3 and 8-15 represent separate cracking schemes in which no two paraffins are cracked together in the same reactor at the same time. If two of the different paraffinic feeds in Examples Nos. 3 and 8-15 were to be cracked simultaneously, each paraffinic feed would be cracked separately, for example, as Feed A and Feed B of FIG. 2. In that manner, the cracking conditions in each reactor can be optimized for the cracking of the one paraffin being cracked therein.

The changes in the absolute percent conversion of the feed components as a result of the pressure increase in each of Examples 1-15 are presented in Table 3. These changes are calculated for a particular feed component in a particular Example by dividing (1) the difference in the concentrations of such component in the effluent at a given temperature but at different reactor outlet pressures for such Example (from Table 2) by (2) the concentration of such component in the feed for that Example (from Table 1). The relative changes in the yields of $C_5+$ and hydrogen as a result of the pressure increase in each of Examples 1-15 are presented in Table 4. These changes are calculated for $C_5+$ or hydrogen in a particular Example by dividing (1) the difference in the concentrations of such material in the effluent at a given temperature but at different reactor outlet pressures for such Example (from Table 2) by (2) the concentration of such material in the effluent at the given temperature at the lower reactor outlet pressure for each Example (from Table 2).

TABLE 1

| Example No. | Feed Composition, Wt. % | Feed Rate, Kg./Hr. | Steam/ Hydrocarbon By Wt. |
|---|---|---|---|
| 1 | 20% ethane<br>20% propane<br>60% ethylene | $15.9 \times 10^3$ | 0.30 |
| 2 | 16.2% ethane<br>16.8% propane<br>47.4% ethylene<br>17.9% butadiene | $15.9 \times 10^3$ | 0.45 |
| 3 | 50% ethane<br>50% ethylene | $9.1 \times 10^3$ | 0.40 |
| 4 | 16% ethane<br>16% propane<br>48% ethylene<br>18% propylene | $15.9 \times 10^3$ | 0.45 |
| 5 | 100% naphtha | $15.9 \times 10^3$ | 0.45 |

TABLE 1-continued

| Example No. | Feed Composition, Wt. % | Feed Rate, Kg./Hr. | Steam/ Hydro-carbon By Wt. |
|---|---|---|---|
| 6 | 50% ethane<br>50% propane | $15.9 \times 10^3$ | 0.30 |
| 7 | 70% ethane<br>30% propane | $15.9 \times 10^3$ | 0.30 |
| 8 | 40% propane<br>60% ethylene | $15.9 \times 10^3$ | 0.35 |
| 9 | 40% propane<br>60% ethylene | $9.1 \times 10^3$ | 0.40 |
| 10 | 60% propane | $15.9 \times 10^3$ | 0.45 |
| 11 | 40% propylene<br>60% ethane | $15.9 \times 10^3$ | 0.45 |
| 12 | 40% propylene<br>70% ethane<br>30% butadiene | $15.9 \times 10^3$ | 0.45 |
| 13 | 60% ethane<br>40% ethylene | $15.9 \times 10^3$ | 0.45 |
| 14 | 100% ethane | $15.9 \times 10^3$ | 0.40 |
| 15 | 100% propane | $15.9 \times 10^3$ | 0.45 |

TABLE 2

| Example No. | Reactor Effluent Composition, Wt. % | | | | | | | | | | | | | | | | | | | |
|---|---|---|---|---|---|---|---|---|---|---|---|---|---|---|---|---|---|---|---|---|
| | Ethylene at ROT of | | | | Propylene at ROT of | | | | Butadiene at ROT of | | | | $C_5^+$ at ROT of | | | | Hydrogen at ROT of | | | |
| | 805° C. at ROP of | | 827° C. at ROP of | | 805° C. at ROP of | | 827° C. at ROP of | | 805° C. at ROP of | | 827° C. at ROP of | | 805° C. at ROP of | | 827° C. at ROP of | | 805° C. at ROP of | | 827° C. at ROP of | |
| | 103 | 166 | 103 | 166 | 103 | 166 | 103 | 166 | 103 | 166 | 103 | 166 | 103 | 166 | 103 | 166 | 103 | 166 | 103 | 166 |
| 1 | 54.0 | 47.0 | 53.5 | 46.0 | 6.6 | 7.3 | 6.0 | 5.9 | 2.1 | 2.7 | 3.3 | 2.7 | 8.0 | 12.1 | 10.8 | 16.8 | 0.70 | 0.90 | 0.80 | 0.90 |
| 2 | 47.1 | 45.1 | 47.9 | 45.3 | 4.2 | 6.2 | 5.9 | 7.2 | 11.4 | 7.4 | 8.1 | 5.3 | 6.3 | 11.4 | 9.6 | 14.7 | 0.30 | 0.50 | 0.55 | 0.70 |
| 3 | 54.5 | 50.5 | — | — | 2.0 | 3.2 | — | — | 2.2 | 2.2 | — | — | 3.9 | 7.4 | — | — | 1.25 | 1.50 | — | — |
| 4 | 50.0 | 49.5 | 50.0 | 48.5 | 17.0 | 13.0 | 17.0 | 15.0 | — | — | 2.0 | 2.5 | 1.4 | 2.6 | 2.5 | 5.6 | 0.20 | 0.40 | 0.40 | 0.60 |
| 5 | 23.6 | 24.2 | 27.0 | 26.8 | 17.8 | 17.0 | 17.0 | 15.5 | 4.8 | 4.4 | 4.9 | 4.3 | 25.8 | 24.8 | 22.8 | 24.0 | 0.80 | 0.80 | 0.70 | 0.80 |
| 6 | 34.5 | 36.9 | 41.6 | 41.5 | 7.6 | 7.1 | 6.3 | 5.4 | | | | | 1.7 | 3.6 | 3.2 | 5.6 | 1.9 | 2.0 | 2.2 | 2.3 |
| 7 | 38.0 | 38.5 | 46.0 | 44.2 | 4.1 | 4.2 | 3.2 | 3.3 | | | | | 1.5 | 2.6 | 3.0 | 5.0 | 2.3 | 2.4 | 2.8 | 2.9 |
| 8 | 52.0 | 46.0 | 50.0 | 43.5 | 11.1 | 11.3 | 10.1 | 9.3 | 3.4 | 3.2 | 3.6 | 3.2 | 7.5 | 13.0 | 11.6 | 17.2 | 0.70 | 0.80 | 1.00 | 1.10 |
| 9 | 52.0 | 49.0 | 51.8 | 45.0 | 10.2 | 11.3 | 10.3 | 9.0 | 3.2 | 3.3 | 3.8 | 3.5 | 5.4 | 11.0 | 8.5 | 15.3 | 0.50 | 0.80 | 0.90 | 1.10 |
| 10 | 6.6 | 12.4 | 14.0 | 19.6 | 39.7 | 37.2 | 36.5 | 33.2 | | | | | 0.8 | 2.4 | 2.7 | 5.3 | 0.20 | 0.30 | 0.40 | 0.60 |
| 11 | 8.0 | 14.2 | 17.6 | 28.0 | 33.8 | 28.4 | 26.6 | 18.5 | | | | | 0.8 | 1.5 | 1.9 | 4.1 | 0.23 | 0.40 | 0.54 | 0.85 |
| 12 | 13.5 | 26.2 | 28.4 | 32.2 | 1.4 | 3.3 | 2.8 | 3.2 | 15.7 | 4.8 | 5.8 | 2.7 | 6.5 | 12.9 | 11.3 | 15.2 | 0.40 | 1.0 | 1.1 | 1.6 |
| 13 | 47.2 | 46.9 | 52.1 | 50.9 | 1.0 | 1.7 | 1.5 | 2.3 | | | | | 2.0 | 2.1 | 2.2 | 4.0 | 0.9 | 1.1 | 1.5 | 1.6 |
| 14 | 33.8 | 35.5 | 43.0 | 43.6 | 0.5 | 0.8 | 0.8 | 0.8 | | | | | 0.4 | 0.5 | 0.7 | 1.3 | 2.5 | 2.7 | 3.3 | 3.4 |
| 15 | 16.1 | 20.2 | 21.9 | 26.0 | 15.2 | 17.5 | 17.6 | 18.6 | | | | | 0.5 | 1.1 | 1.1 | 2.3 | 0.8 | 0.9 | 1.1 | 1.2 |

| Example No. | Ethane at ROT of | | | | Propane at ROT of | | | |
|---|---|---|---|---|---|---|---|---|
| | 805° C. at ROP of | | 827° C. at ROP of | | 805° C. at ROP of | | 827° C. at ROP of | |
| | 103 | 166 | 103 | 166 | 103 | 166 | 103 | 166 |
| 1 | 16.0 | 17.8 | 13.0 | 14.2 | 4.5 | 3.2 | 2.4 | 1.5 |
| 2 | 14.9 | 14.7 | 13.5 | 13.0 | 12.5 | 9.8 | 6.4 | 9.3 |
| 3 | 33.0 | 31.5 | — | — | — | — | — | — |
| 4 | 15.0 | 13.0 | 14.0 | 14.0 | 13.3 | 11.0 | 11.3 | 7.4 |
| 5 | — | — | — | — | — | — | — | — |
| 6 | 30.3 | 28.1 | 23.9 | 22.5 | 10.7 | 6.3 | 6.0 | 3.2 |
| 7 | 38.8 | 37.2 | 28.8 | 26.8 | 5.5 | 3.6 | 2.3 | 1.3 |
| 8 | — | — | — | — | 11.5 | 7.2 | 7.2 | 4.0 |
| 9 | — | — | — | — | 14.4 | 8.3 | 9.0 | 5.0 |
| 10 | — | — | — | — | >45 | 36.3 | 35.0 | 25.0 |
| 11 | 54.0 | 49.2 | 46.4 | 38.0 | 0.1 | 0.2 | 0.2 | 0.35 |
| 12 | 59.2 | 47.1 | 44.7 | 36.7 | — | — | 0.1 | 0.2 |
| 13 | 47.1 | 44.8 | 38.3 | 35.6 | 0.1 | 0.1 | 0.1 | 0.2 |
| 14 | 60.7 | 57.7 | 48.8 | 45.8 | 0.1 | 0.1 | 0.2 | 0.2 |
| 15 | 1.5 | 2.5 | 2.0 | 3.1 | 55.5 | 43.7 | 41.6 | 30.1 |

TABLE 3

| Example No. | CHANGE IN ABSOLUTE PERCENT CONVERSION | | | | | | | | | |
|---|---|---|---|---|---|---|---|---|---|---|
| | Ethylene at ROT of | | Propylene at ROT of | | Butadiene at ROT of | | Ethane at ROT of | | Propane at ROT of | |
| | 805 | 827 | 805 | 827 | 805 | 827 | 805 | 827 | 805 | 827 |
| 1 | +12 | +13 | | | | | −9 | −6 | +7 | +5 |
| 2 | +4 | +5 | | | +21 | +16 | +1 | +3 | +16 | −17 |
| 3 | +8 | | | | | | +3 | | | |
| 4 | +1 | +3 | +22 | +1 | | | +13 | 0 | +14 | +24 |
| 5 | | | | | | | | | | |
| 6 | | | | | | | +5 | +3 | +8 | +6 |
| 7 | | | | | | | +2 | +3 | +6 | +4 |
| 8 | +10 | +13 | | | | | | | +11 | +8 |
| 9 | +5 | +11 | | | | | | | +15 | +10 |
| 10 | | | +6 | +8 | | | | | >+15 | +8 |
| 11 | | | +13 | +20 | | | +8 | +14 | | |
| 12 | | | | | +36 | +10 | +18 | +12 | | |

TABLE 3-continued

| Example No. | CHANGE IN ABSOLUTE PERCENT CONVERSION | | | | | | | | | |
|---|---|---|---|---|---|---|---|---|---|---|
| | Ethylene at ROT of | | Propylene at ROT of | | Butadiene at ROT of | | Ethane at ROT of | | Propane at ROT of | |
| | 805 | 827 | 805 | 827 | 805 | 827 | 805 | 827 | 805 | 827 |
| 13 | +2 | +3 | | | | | +3 | +5 | | |
| 14 | | | | | | | +3 | +3 | | |
| 15 | | | | | | | | | +12 | +11 |

TABLE 4

| Example No. | RELATIVE CHANGE IN YIELD OF | | | |
|---|---|---|---|---|
| | $C_5$+ at ROT of | | Hydrogen at ROT of | |
| | 805 | 827 | 805 | 827 |
| 1 | +51 | +56 | +29 | +13 |
| 2 | +81 | +52 | +67 | +27 |
| 3 | +90 | — | +20 | — |
| 4 | +86 | +112 | +100 | +50 |
| 5 | −4 | +5 | 0 | +14 |
| 6 | +112 | +75 | +5 | +5 |
| 7 | +73 | +67 | +4 | +4 |
| 8 | +73 | +48 | +14 | −10 |
| 9 | +104 | +80 | +60 | +22 |
| 10 | +200 | +96 | +50 | −50 |
| 11 | +88 | +116 | +74 | −57 |
| 12 | +98 | +35 | +150 | −45 |
| 13 | +5 | +82 | +20 | +7 |
| 14 | +25 | +86 | +8 | +3 |
| 15 | +120 | +109 | +13 | +9 |

The results presented in Tables 2 and 4 illustrate that, in all cases except Example 5 where naphtha is the feed, the yields of $C_5$+ (pyrolysis gasoline) and of hydrogen at a given reactor outlet temperature are greater at the greater reactor oulet pressure of 166 centimeters of mercury on an absolute pressure basis than at the lower reactor outlet pressure of 103 centimeters of mercury on an absolute pressure basis. Furthermore, as the results in Table 2 illustrate, in 9 of Examples 1–15, including in Example 5, the yields of $C_5$+ at the higher reactor outlet pressure of 166 centimeters of mercury and the lower reactor outlet temperature of 805° C. are greater than at the lower reactor outlet pressure of 103 centimeters of mercury and higher reactor outlet temperature of 827° C. In 5 of the other Examples, the yields of $C_5$+ at the higher reactor outlet pressure and the lower reactor outlet temperature are not excessively smaller than at the lower reactor outlet pressure and higher reactor outlet temperature. This indicates that about the same, or in some cases greater, yields of $C_5$+ can be effected using the method of this invention at lower cracking temperatures—that is, with lower cracking severities and less fuel consumption—than using conventional thermal cracking with higher cracking temperatures and lower reactor pressures.

The results presented in Tables 2 and 3 illustrate that, in all cases when ethylene, propylene or butadiene is a feed component, the extents of conversion of ethylene, propylene or butadiene, respectively, at a given reactor outlet temperature are greater at the greater reactor outlet pressure of 166 centimeters of mercury on an absolute pressure basis than at the lower reactor outlet pressure of 103 centimeters of mercury on an absolute pressure basis. The results presented in Tables 2 and 3 illustrate that, in all cases except one when ethane or propane is a feed component, the extent of conversion of ethane or propane, respectively, at a given reactor outlet temperature are greater at the greater reactor outlet pressure of 166 centimeters of mercury on an absolute pressure basis than at the lower reactor outlet pressure of 103 centimeters of mercury on an absolute pressure basis.

The results presented in Tables 2 and 4 illustrate that feeds comprising certain combinations of paraffins and recycled olefins afford a synergistic increase in the yields of hydrogen and pyrolysis gasoline relative to the increases therein afforded by feeds comprising other combinations of paraffins and recycled olefins. The yields of hydrogen and pyrolysis gasoline are significantly larger when the feed comprises a combination of ethane and propylene or of propane and ethylene than when the feed comprises a combination of ethane and ethylene or of propane and propylene. For example, comparison of the results in Tables 2 and 4 for Examples 11, 13 and 14 illustrates that the yields of both $C_5$+ and hydrogen in the method of this invention are substantially greater when the hydrogen feed is a mixture of ethane and propylene than when the hydrocarbon feed is ethane alone or a mixture of ethane and ethylene.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

Having described the invention, what is claimed is:

1. In a method for thermally cracking a feed comprising at least one hydrocarbon selected from the group consisting of paraffins containing up to 10 carbon atoms, naphthas, gas oils and mixtures thereof, to thereby produce hydrogen, methane, olefins, naphthenes and aromatics, comprising:

passing the feed at a positive pressure into a reactor;

cracking the feed in the reactor at a temperature in the range of from about 425° C. to about 930° C. in the presence of steam at a steam-to-hydrocarbon weight ratio in the range of from about 0.2:1 to about 1.5:1;

pressurizing the reactor effluent in a compressor from substantially atmospheric pressure; and fractionating the pressurized reactor effluent;

the improvement comprising cracking the feed in the reactor at a reactor pressure (1) such that the reactor outlet is maintained at a pressure, on an absolute pressure basis, that is at least 100 percent higher than the reactor outlet pressure which results when the reactor is operated at a pressure so as to maximize the yield of ethylene or propylene or both in the particular reactor and (2) such that either an increased yield of pyrolysis gasoline is afforded or substantially the same yield of pyrolysis gasoline is afforded but at reduced cracking severity, relative to cracking at the aforesaid reactor pressure at which the yield of ethylene or propylene or both is maximized in that particular reactor.

2. The method of claim 1 wherein the increase in the reactor pressure is such that the reactor outlet pressure is at a second level at least 300 percent higher than the first level therefor, on an absolute pressure basis.

3. The method of claim 1 wherein the hydrocarbon feed comprises at least one paraffin of 2 to 4 carbon atoms and mixtures thereof.

4. The method of claim 3 wherein the hydrocarbon feed comprises at least one of ethane and propane.

5. The method of claim 1 wherein one hydrocarbon feed and one reactor are employed.

6. The method of claim 1 wherein a first hydrocarbon feed comprising ethane and propane at a weight ratio of ethane-to-propane of at least 3:2 is thermally cracked in a first reactor and separately a second hydrocarbon feed comprising ethane and propane at a weight ratio of propane-to-ethane of a least 3:2 is thermally cracked in a second reactor.

7. The method of claim 6 wherein a substantial portion of propylene product is combined with fresh hydrocarbons and recycled to the first reactor in the first feed, or a substantial portion of ethylene product is combined with fresh hydrocarbons and recycled to the second reactor in the second feed, or both.

8. The method of claim 1 wherein the steam-to-hydrocarbon weight ratio in the reactor is in the range of from about 0.2:1 to about 1.2:1.

9. The method of claim 1 wherein a substantial portion of at least one of the olefinic products is combined with fresh hydrocarbons and recycled to the reactor in the feed.

10. The method of claim 8 wherein a feed comprising at least 60 weight percent of ethane is cracked and a substantial portion of propylene product is combined with ethane and recycled to the reactor in the feed.

11. The method of claim 8 wherein a feed comprising at least 60 weight percent of propane is cracked and a substantial portion of ethylene products is combined with propane and recycled to the reactor in the feed.

* * * * *

UNITED STATES PATENT OFFICE
CERTIFICATE OF CORRECTION

Patent No. 4,548,706 Dated October 22, 1985

Inventor(s) C. G. Papadopoulos and N. Calamur

It is certified that error appears in the above-identified patent and that said Letters Patent are hereby corrected as shown below:

Patent

| Column | Line | | | |
|---|---|---|---|---|
| 2 | 45 | "of at one of" | should be | --"of at least one of"-- |

Signed and Sealed this

*Twenty-fifth* Day of *February 1986*

[SEAL]

*Attest:*

DONALD J. QUIGG

*Attesting Officer*

*Commissioner of Patents and Trademarks*